US006176419B1

(12) United States Patent
Holley, Jr.

(10) Patent No.: US 6,176,419 B1
(45) Date of Patent: Jan. 23, 2001

(54) CARTON WITH ARTICLE DISPENSING FEATURE

(75) Inventor: John M. Holley, Jr., Lawrenceville, GA (US)

(73) Assignee: The Mead Corporation, Dayton, OH (US)

( * ) Notice: Under 35 U.S.C. 154(b), the term of this patent shall be extended for 0 days.

(21) Appl. No.: 09/515,994

(22) Filed: Feb. 29, 2000

(51) Int. Cl.[7] ..... B65D 5/54

(52) U.S. Cl. ..... 229/122.1; 221/305; 229/221; 229/242

(58) Field of Search ..... 229/122.1, 221, 229/241, 242; 221/305

(56) References Cited

U.S. PATENT DOCUMENTS

| | | | | |
|---|---|---|---|---|
| 3,207,380 | * | 9/1965 | Hennessey | 229/242 |
| 3,263,861 | * | 8/1966 | Carr | 229/242 |
| 3,263,899 | | 8/1966 | Collura et al. | 229/212 |
| 3,265,283 | | 8/1966 | Farquhar | 229/221 |
| 3,300,115 | * | 1/1967 | Schauer | 221/305 |
| 3,356,279 | * | 12/1967 | Root | 229/221 |
| 3,416,719 | * | 12/1968 | Pilger | 229/122.1 |
| 3,484,034 | | 12/1969 | Sternau | 229/215 |
| 3,894,681 | * | 7/1975 | Arneson et al. | 229/122.1 |
| 4,364,509 | * | 12/1982 | Holley, Jr. et al. | 229/221 |
| 4,396,143 | * | 8/1983 | Killy | 229/122.1 |
| 4,958,734 | * | 9/1990 | Wood et al. | 229/242 |
| 5,505,372 | * | 4/1996 | Edson et al. | 229/242 |
| 5,531,376 | | 7/1996 | Brink et al. | 229/215 |
| 5,678,755 | | 10/1997 | Block | 229/215 |
| 5,878,947 | * | 3/1999 | Hoy et al. | 221/305 |

* cited by examiner

*Primary Examiner*—Gary E. Elkins
(74) *Attorney, Agent, or Firm*—Tsugihko Suzuki

(57) ABSTRACT

A carton has top and bottom walls that are interconnected by a pair of opposed side walls to form a tubular structure. An end closure structure is provided at each end of the tubular structure to at least partially close that end. One or each of the end closure structures includes a bottom end flap, a pair of side end flaps and a pair of web panels. The bottom end flap is foldably joined to the bottom wall and extends upwardly. The side end flaps are foldably joined respectively to the side walls and extend to each other to traverse the respective end of the tubular structure and to cover at least part of the bottom end flap. Each web panel foldably interconnects the bottom end flap and the respective side end flap and is disposed in a face-contacting relationship with the inside surface of the respective side end flap. A pair of first tear lines are formed respectively in the side end flaps. Each first tear line extends between the adjacent side wall and the adjacent web panel. A pair of second tear lines are also formed respectively in the side end flaps. The second tear lines emanate respectively from the first tear lines and extend to each other to form a single continuous line disposed above the first tear lines.

17 Claims, 4 Drawing Sheets

CARTON WITH ARTICLE DISPENSING FEATURE

BACKGROUND OF THE INVENTION

This invention relates generally to cartons for packaging multiple articles such as beverage cans, bottles and the like, and more particularly to a paperboard carton with an article dispensing feature for providing an access opening through which articles in the carton may be dispensed one by one.

Beverage cartons with a built-in dispensing feature are known in the art. One example is disclosed in U.S. Pat. No. 4,364,509 in which a can dispensing feature is torn out of an end closure structure at one end of a tubular carton. The end closure structure is composed of a bottom end flap, a pair of side end flaps and a pair of web panels each foldably interconnecting the bottom end flap to a respective side end flap. A pair of tear lines are formed in the side end flaps respectively to facilitate tearing of the end closure structure. Tearing along the tear lines provides a swingable dispensing feature formed of the bottom end flap, the web panels and portions of the side end flaps which have become free of the remainder of the side end flaps. The dispensing feature so torn out may be moved outwardly and downwardly to define in the end closure structure an access opening through which the cans may be removed one at a time. A drawback of this carton is that each side end flap must be individually torn along the respective tear line to have the dispensing feature ready to use. It may even require that the side end flaps be pressed at more than one location along each tear line to break the tear lines.

What is needed, therefore, is a carton that is provided with an improved article-dispensing feature that is convenient to use. Such a carton should allow both the tear lines to break by a single tearing action.

SUMMARY OF THE INVENTION

According to this invention in one form, a carton with an improved article-dispensing feature is provided. The carton comprises top and bottom walls that are interconnected by a pair of opposed side walls to form a tubular structure. An end closure structure is provided at each end of the tubular structure to at least partially close that end. One or each of the end closure structures includes a bottom end flap, a pair of side end flaps and a pair of web panels. The bottom end flap is foldably joined to the bottom wall and extends upwardly. The side end flaps are foldably joined respectively to the side walls and extend to each other to traverse the respective end of the tubular structure as well as to cover at least part of the bottom end flap. Each web panel foldably interconnects the bottom end flap with the respective side end flap and it is disposed in a face-contacting relationship with the inside surface of the respective side end flap. A pair of first tear lines are formed respectively in the side end flaps. Each first tear line extends between the adjacent side wall and the adjacent web panel. A pair of second tear lines are also formed respectively in the side end flaps. These second tear lines emanate respectively from the first tear lines and extend to each other to form a single continuous line disposed above the first tear lines.

The carton in this form of the invention provides a tear panel that may be torn off of the carton. The tear panel is defined along its upper edge by the second tear lines and along its lower edge at least in part by the first tear lines. Cutting of the tear panel may be initiated by pulling the tear panel outwardly and downwardly. The tear panel may be pulled either alone or together with the bottom end flap which is a primary portion of the swingable dispensing feature. When the tear panel is pulled alone, the second and first tear lines successively break in the described sequence, allowing the tear panel to be severed from the carton. This exposes the bottom end flap for its swing out movement. When the tear panel is pulled together with the bottom end flap, the second tear lines break first and then do the first tear lines during the downward swinging movement of the bottom end flap. In either case, the first and second tear lines may be broken by a single downward pulling action on the tear panel.

In a preferred embodiment of the invention, each first tear line extends from the adjacent side wall and terminates in coincidence with the inner end of the fold line between the respective side end flap and the adjacent web panel. This arrangement eliminates an additional fold line or extension of the first tear line that would otherwise be required in the adjacent web panel.

In another preferred embodiment, each first tear line may have an upper end on the junction between the adjacent side wall and the respective side end flap. In this embodiment, the second tear lines may emanate respectively from the upper ends of the first tear lines. Alternatively, each second tear line may emanate from a point along the adjacent first tear line.

In still another preferred embodiment, each first tear line may be arched and lie concave to the second tear lines. This arrangement facilitates smooth breaking of the first tear lines while the tear panel is pulled.

In a further preferred embodiment, the continuous line formed of the second tear lines may have an upwardly convexly curved portion for defining a centrally located pull tab. Such a tab provides a convenience for a customer to hold the tear panel.

In a still further preferred embodiment, the continuous line may have a downwardly convexly curved portion for defining a downwardly depending leg for engaging the bottom end flap. The leg may be used to engage the bottom end flap to lock the dispensing feature in a closed position when the feature is swung back to the closed position to reclose an access opening in the respective end closure structure.

In a still further preferred embodiment, the carton may further comprise a pair of third tear lines extending upwardly from the continuous line to define an access tab therebetween for facilitating tearing of the side end flaps along the second tear lines.

In a still further preferred embodiment, the side end flaps may be disposed in an overlapping relationship, and the second tear lines extend coincidentally with each other in the area where the side end flaps are overlapped.

The present invention in another form provides a carton blank comprising a bottom wall, a pair of side walls, a bottom end flap, a pair of side end flaps and a pair of web panels. The side walls are foldably joined to the opposite side edges of the bottom wall. The bottom end flap is foldably joined to one of the opposite end edges of the bottom wall. The side end flaps are foldably joined respectively to the respective end edges of the side walls adjacent to the bottom end flap so that when the blank is erected into a carton, the side end flaps extend to each other to traverse the respective end of the carton and to cover at least part of the bottom end flap. Each web panel foldably interconnects the bottom end flap with the respective side end flap. A pair of first tear lines are formed in the side end flaps, respectively. Each first tear line extends between the adjacent side wall and the adjacent web panel. A pair of second tear lines are also formed in the side end flaps, respectively. Each second tear line extends from the adjacent first tear line to the free end edge of the respective side end flap so that when the carton is erected, the second tear lines form a single continuous line disposed above the first tear lines.

DETAILED DESCRIPTION OF THE PREFERRED EMBODIMENTS

Figure 1:
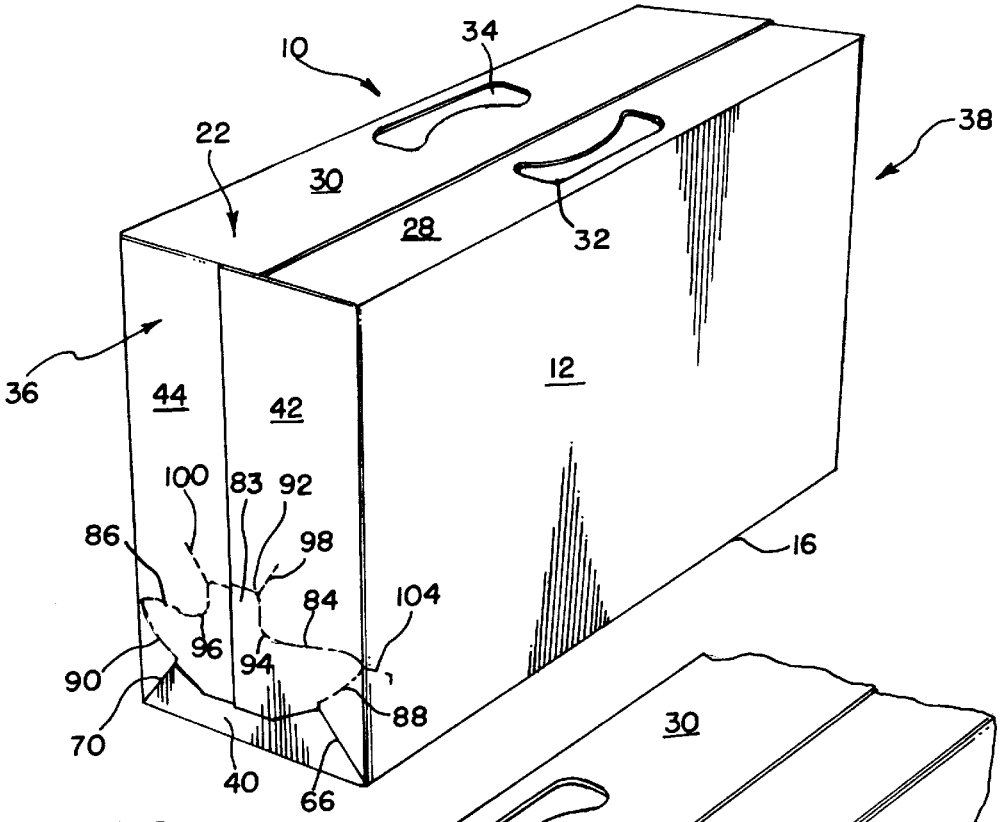
FIG. 1 is a perspective view of an erected carton according to the present invention.
Figure 5:
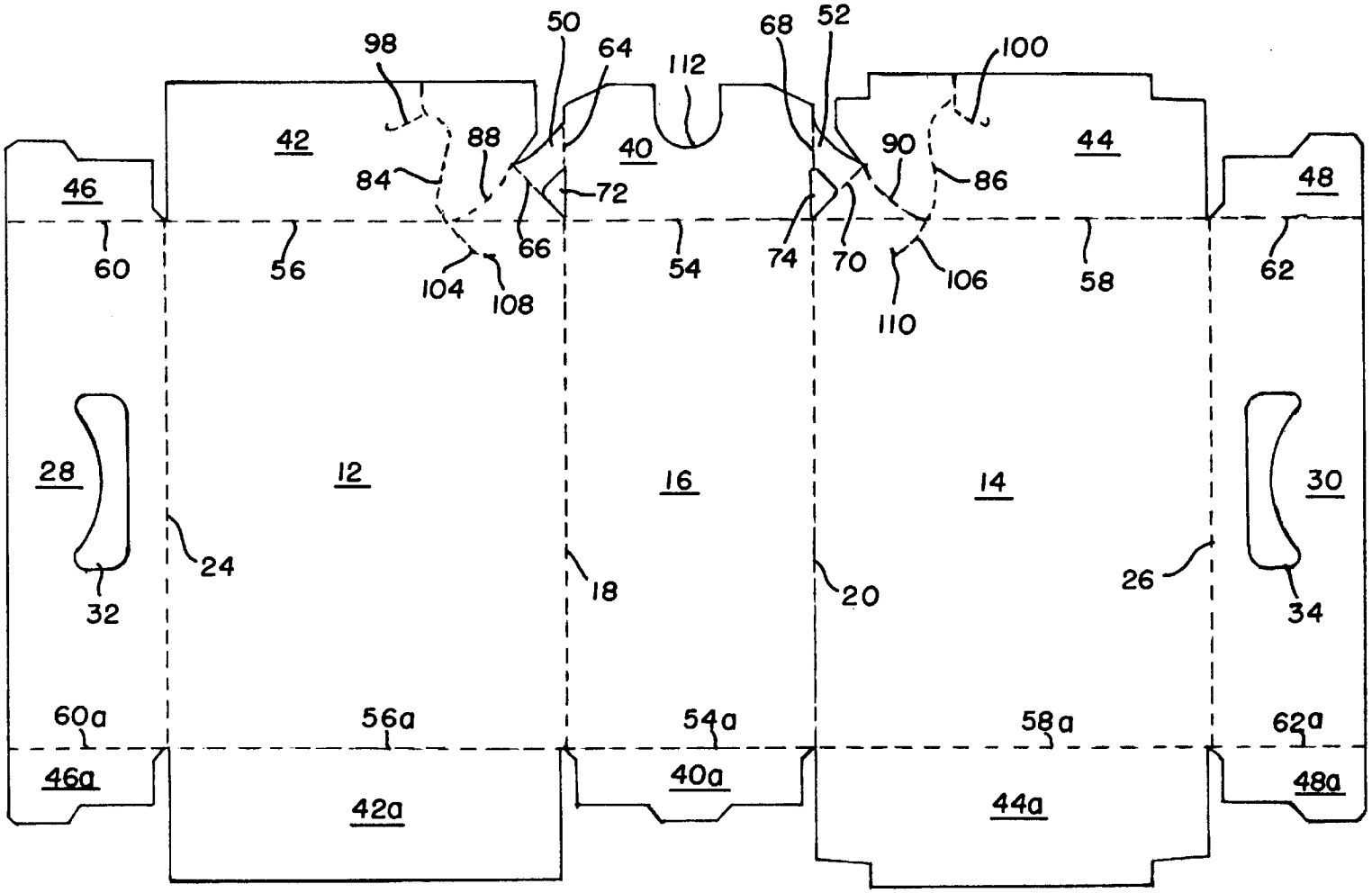
FIG. 5 is a plan view of a blank from which the carton in FIG. 1 is erected.

FIG. 1 shows a carton 10 according to the invention, having an improved article-dispensing feature while FIG. 5 shows a carton blank from which the carton 10 is erected. The carton 10 is designed to package multiple articles such as twelve beverage cans. Referring to FIGS. 1 and 5, the carton 10 comprises a pair of side walls 12 and 14 foldably joined respectively to the opposite side edges of a bottom wall 16 along fold lines 18 and 20. The side walls 12 and 14 extend upwardly to their respective upper edges and a top wall 22 is foldably joined to the upper edges of the side walls 12 and 14 along fold lines 24 and 26. As a result, an open-ended tubular structure is formed by the top, bottom and side walls 22, 16, 12 and 14. The top wall 22 is formed of two top lap panels 28 and 30 glued together in an overlapping relationship as is known in the art. The top lap panels 28 and 30 are provided with handle means for carrying the carton. Such handle means is shown in the form of a pair of hand openings 32 and 34 in the top lap panels 28 and 30.

At each end of the aforementioned tubular structure, there is provided an end closure structure shown generally by the numerals 36 and 38. The end closure structures 36 and 38 in FIG. 1 are shown as fully closing the respective ends of the tubular structure; however they may be designed to partially close one or both ends of the carton. An example of a beverage can carton having partially closed ends is disclosed in U.S. Pat. No. 3,894,681 which is hereby incorporated by reference. The corner windows shown in this U.S. patent may be employed at least at the two upper corners of the carton 10.

Referring to FIG. 5, the end closure structure 36 comprises a bottom end flap 40, a pair of side end flaps 42 and 44, top end flaps 46 and 48 and a pair of web panels 50 and 52. The bottom end flap 40 is foldably joined to the bottom wall 16 along a fold line 54. The side end flaps 42 and 44 are foldably joined to the side walls 12 and 14 along fold lines 56 and 58, respectively. The top end flaps 46 and 48 are foldably joined to the top lap panels 28 and 30 along fold lines 60 and 62, respectively. The web panels 50 and 52 interconnect the bottom end flap 40 and the respective side end flaps 42 and 44. More specifically, the web panel 50 is foldably joined to the bottom end flap 40 along a fold line 64 and to the side end flap 42 along a fold line 66 while the web panel 52 is foldably joined to the bottom end flap 40 along a fold line 68 and to the side end flap 44 along a fold line 70. These web panels 50 and 52 are formed respectively with apertures 72 and 74 for facilitating folding of the bottom and side end flaps 40, 42 and 44.

Referring to FIG. 1, the bottom end flap 40 is folded upwardly along the fold line 54 to take a vertical position. The web panels 50 and 52 are folded along the fold lines 66 and 70 together with the bottom end flap 40 to be in a face-contacting relationship with the respective inside surfaces of the side end flaps 42 and 44. The top end flaps 46 and 48 are glued together in an overlapping relationship and are folded down along the fold lines 60 and 62 to take a vertical position (not shown). The side end flaps 42 and 44 are folded toward each other along the fold lines 56 and 58 to take respective closed positions. In these positions, the side end flaps 42 and 44 are glued together in an overlapping relationship to traverse the respective end of the carton. As a result, the side end flaps 42 and 44 cover the most of the exterior of the top and bottom end flaps 46, 48 and 40 except the lower end portion of the bottom flap 40. The side end flaps 42 and 44 may be glued to the exterior of the top and bottom end flaps 40, 46 and 48. Alternatively, they may be merely in contact with the top and bottom end flaps without glue. When the side end flaps 42 and 44 are folded to the closed position, the web panels 50 and 52 take the position between the bottom end flap 40 and the respective side end flaps 42 and 44 and are in a face-contacting relationship with them.

The other end closure structure 38 comprises a similar set of end flaps connected to the tubular structure in virtually the same way except that the end closure structure 38 includes no web panel. Therefore, the parts of the structure 38 corresponding to those of the structure 36 are designated by similar reference numerals with the subscript "a", and the description thereof is omitted.

Figure 2:
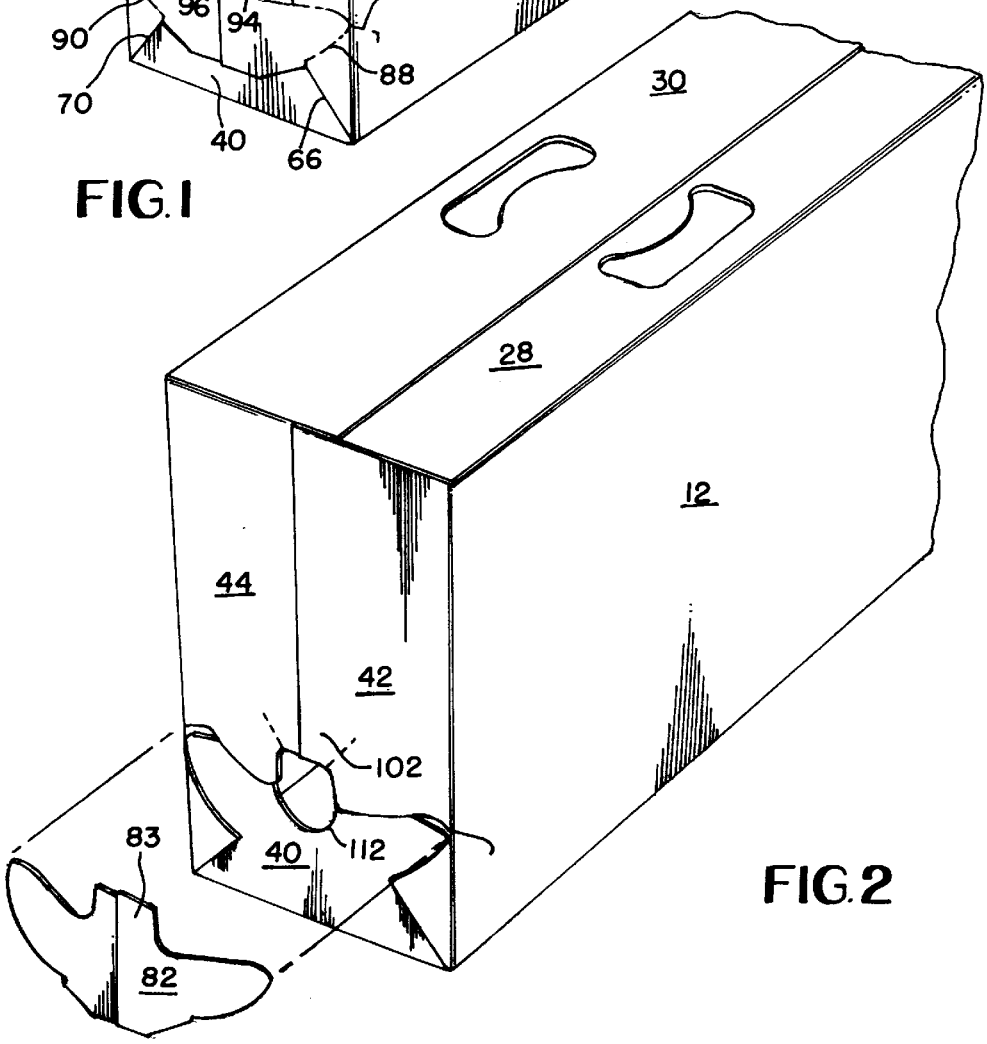
FIG. 2 is a fragmentary perspective view of the carton of FIG. 1, showing the tear panel severed from the respective end of the carton.
Figure 3:
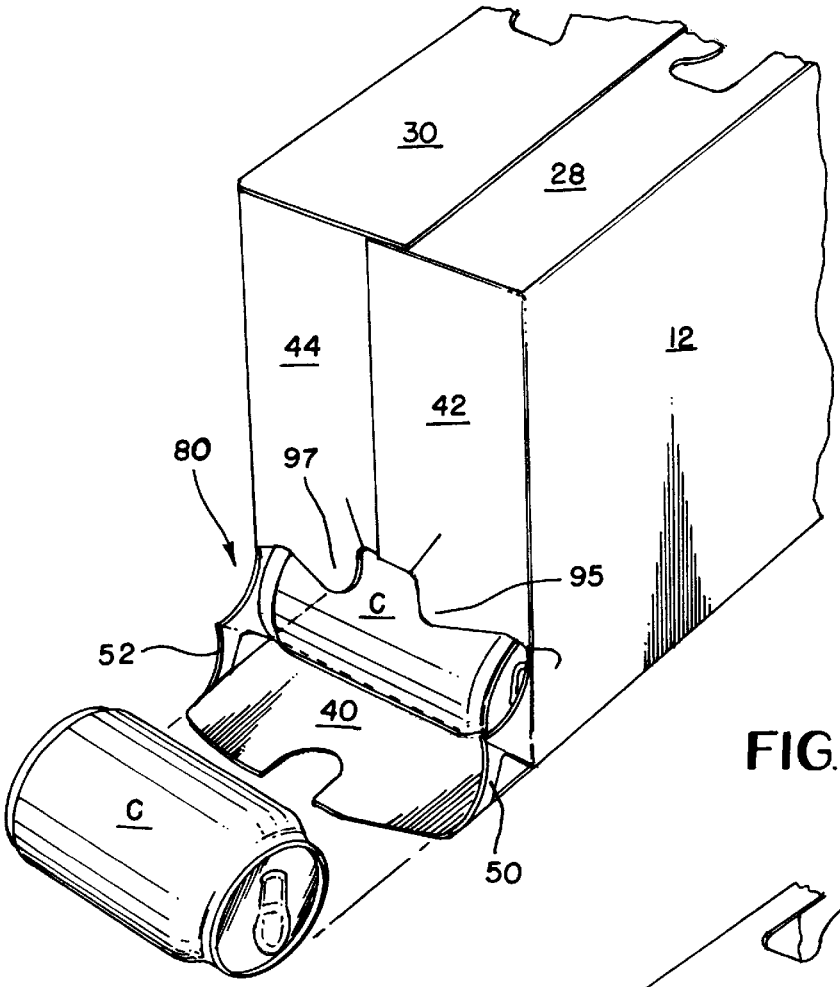
FIG. 3 is a fragmentary perspective view of the carton in FIG. 1, showing the dispensing feature lowered to the opened, dispensing position.

Built into the end closure structure 36 is a swingable can-dispensing feature 80 as best shown in FIG. 3 and a tear panel 82 (best shown in FIG. 2) for facilitating customer's access to the dispensing feature 80. These features 80 and 82, as are described later in more detail, are designed to be torn out of the end closure structure 36 by means of a pair of upper tear lines 84 and 86 and a pair of lower tear lines 88 and 90 formed in the side end flaps 42 and 44. The "tear line" in this application refers to a perforated slit which is formed in the paperboard material from which the carton is formed and functions to split a part of the paperboard material in two. The "perforated slit" refers to a line consisting of a plurality of short slits arranged at spacings and ready to split along the line when subject to external force.

Referring further to FIG. 5, the upper tear line 84 emanates from the fold line 56 and extends across the side end flap 42 to the free end edge of the flap 42. The lower tear line 88 emanates from the intersection of the upper tear line 84 and the fold line 56 and extends to the end of the fold line 66 located remote from the side wall 12. In other words, the lower tear line 88 terminates at the point of coincidence with the upper end of the fold line 66 as viewed in FIG. 1. In like manner, the upper tear line 86 emanates from the fold line 58 and extends across the side end flap 44 to the free end edge of the flap 44. The lower tear line 90 emanates from the intersection of the upper tear line 86 and the fold line 58 and extends to the upper end of the fold line 70 as viewed in FIG. 1. When the side end flaps 42 and 44 are in their closed positions as shown in FIG. 1, the upper tear lines 84 and 86 form a single continuous line extending entirely across the respective end of the carton. The continuous line is curved such that it has an upwardly convexly arched portion 92 centrally located along its length and a pair of downwardly convexly curved portions 94 and 96 located on the opposite sides of the portion 92. The portion 92, when broken, defines a pull tab 83 (FIG. 2) on the tear panel 82 while the portions 94 and 96, when broken, define downwardly depending legs 95 and 97 (FIG. 3). The lower tear lines 88 and 90 are also arched and lie concave to the adjacent upper tear lines 84 and 86. Such curvature of the lower tear lines 88 and 90 facilitates their smooth breaking when the tear panel 82 is pulled downwardly.

Further, a pair of access tear lines 98 and 100 extend upwardly from the arched portion 92 and terminate interiorly of the side end flaps 42 and 44. These access tear lines 98 and 100, when broken, define an access tab 102 (FIG. 2) therebetween for facilitating access to the pull tab 83.

In addition, expansion tear lines 104 and 106 extend respectively from the opposite ends of the continuous line (i.e., the unified upper tear lines 84 and 86) and are disposed in the side walls 12 and 14, respectively. In order to prevent excessive tearing of side walls 12 and 14, expansion tear lines 104 and 106 are provided respectively with termination cuts 108 and 110 which are hook shaped and curve generally toward the bottom wall 16 and terminate interiorly of the respective side walls 12 and 14.

In order to utilize the dispensing feature 80, the access tab 102 is manually pressed inwardly of the carton, and thereby the access tear lines 98 and 100 and the arched portion 92 of the upper tear lines are broken to render the pull tab 83 accessible. The pull tab 83 is then held by the user's fingers and pulled downwardly to resume breaking of the upper tear lines 84 and 86. Successive downward pulling of the pull tab 83 breaks the upper tear lines 84 and 86 to their outer ends and incessantly the lower tear lines 88 and 90 all the way to their lower ends. This causes the tear panel 82 to be severed from the carton as shown in FIG. 2, which exposes the upper edge of the bottom end flap 40 and thereby renders the bottom end flap 40 ready to be manipulated. Thereafter, the bottom end flap 40 is manually lowered to the opened position shown in FIG. 3. As the flap 40 is lowered, the web panels 50 and 52 and the adjacent portions of the side end flaps 42 and 44 are unfolded to form the parts of the dispensing feature which interconnect the flap 40 with the side walls 12 and 14. The cans in the carton 10 are then taken out of the carton through the access opening created by lowering of the bottom end flap 40.

In the illustrated embodiment, the bottom end flap 40 is formed with a notch or cutout 112 (FIGS. 1 and 2) to prevent the bottom end flap 40 from being held by the user's fingers when the pull tab 83 is accessed. Pulling the pull tab 83 alone may eventually allow the tear panel 82 to be completely separated from the carton. However, the bottom end flap 40 may be formed without the notch 112 so that the upper edge of the flap 40 may be held by the user's fingers along with the pull tab 83. When held together with the pull tab 83, the bottom side flap 40 may be lowered simultaneously with the tearing of the tear panel 82. In this case, the tear panel 82 may remain glued to the outside surface of the bottom end flap 40.

It can be seen by referring to FIG. 3, that the lowered bottom end flap 40 serves as a tray upon which the cans C may roll over when removing them from the carton 10. It should also be obvious from FIG. 3 that the downwardly depending legs 95 and 97 retain the cans C in the carton so that the cans C can be removed only one at a time without the remaining cans being forced out of the carton 10 due to the weight of successive cans piled on top thereof. Without the legs 95 and 97, the remaining cans would all roll out at one time When the cans C are removed from the carton 10, the expansion tear lines 104 and 106 may be broken to conveniently grasp a can C around the ends thereof. Breaking of the expansion tear lines 104 and 106 allows sufficient space for the user's fingers to occupy positions between the ends of the can C and the side walls 12 and 14.

Figure 4:
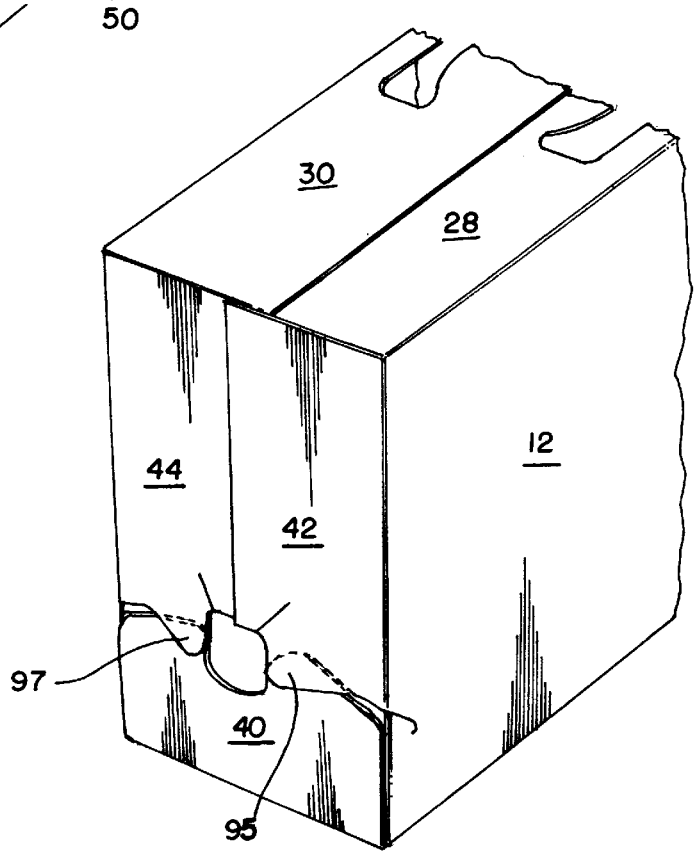
FIG. 4 is a fragmentary perspective view of the carton of FIG. 1, showing the dispensing feature reclosed and retained in the closed position by means of the downwardly depending legs formed from the end closure structure at the respective end of the carton.

In order to render the dispensing feature 80 reusable, it is simply necessary to swing the bottom end flap 40 upwardly about the fold line 54 and to tuck the upper end of the bottom end flap 40 underneath the legs 95 and 97. This condition is best shown in FIG. 4. In this manner, an accidental discharge of the cans C is prevented because the bottom end flap 40 is in effect locked in place.

Figure 6:
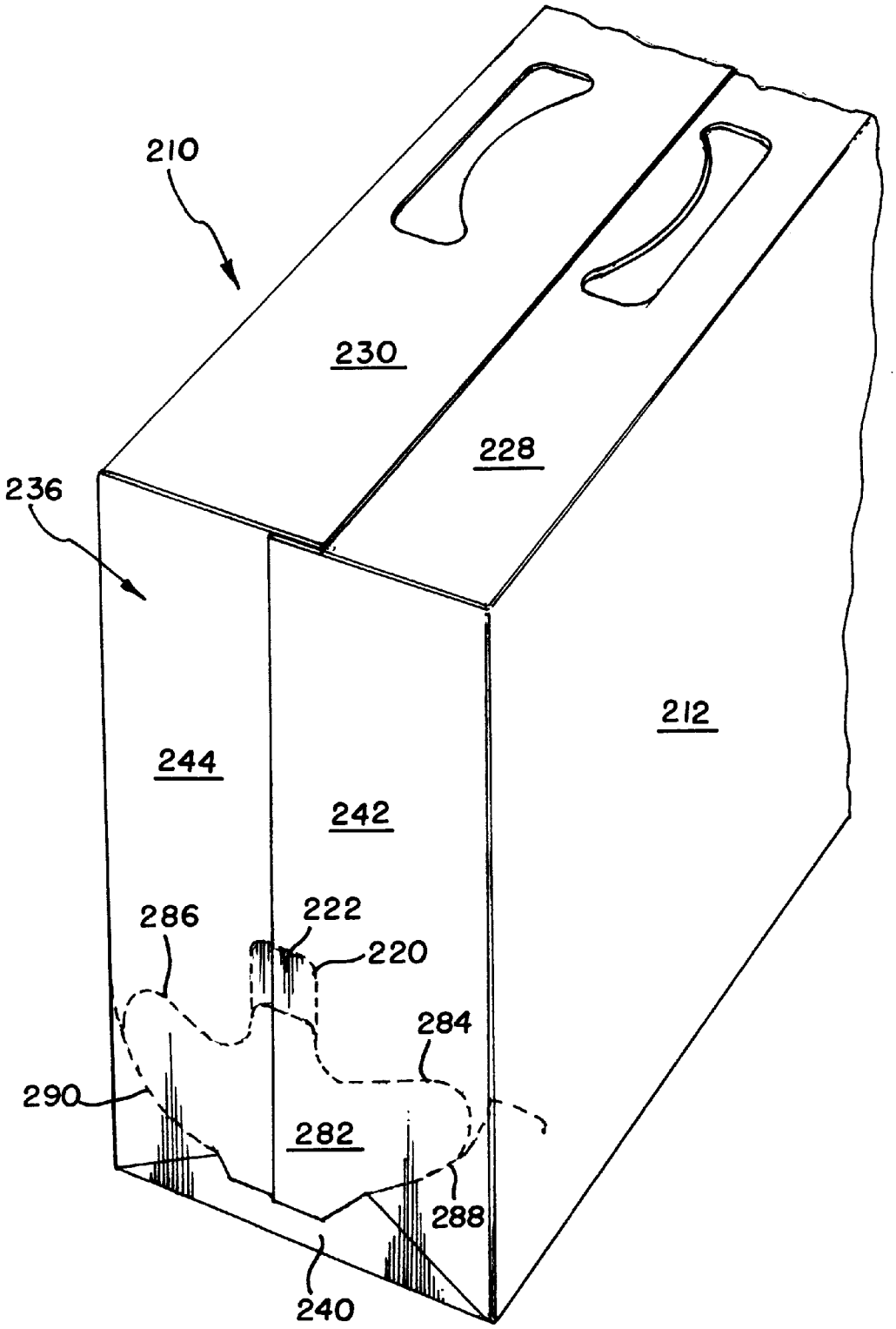
FIG. 6 is a fragmentary perspective view of a carton of an alternative embodiment according to the present invention.

FIG. 6 illustrates an alternative embodiment of carton of the invention. The carton 210 of this embodiment has an inverted U-shaped access tear line 220 in place of the pair of access tear lines 98 and 100 in FIG. 1. The access tear line 220, when broken, defines a punch-out feature 222 in the respective end closure structure 236 so that the user's finger may be easily inserted into the carton 210 to start tearing out of the tear panel 282 along its pre-determined path. Further, unlike the carton of the preceding embodiment, the upper tear lines 284 and 286 emanate respectively from points along the lower tear lines 288 and 290. It is preferred that each upper tear line 284 and 286 and the adjacent lower tear line 288 and 290 form a smoothly curved continuous line to facilitate incessant tearing along those upper and lower tear lines. The remainder of the carton 210 is virtually identical to the carton in FIG. 1, and thus the parts of the carton 210 corresponding to those of in FIG. 1 are denoted by similar reference numerals that are greater by 200 than the corresponding parts in FIG. 1 and the description thereof is omitted.

From the foregoing, it can be seen that there has been provided by the subject invention a new carton for multiple articles such as cans or the like having an improved tear-out dispensing feature formed on at least one end of the carton. It is apparent from a review of the specification and a study of the drawing that many changes may be made in the various features of the invention without departing from the spirit and scope of the invention, and the invention is not to be limited to the exact features shown which have been shown by way of illustration only. For example, it should be appreciated that the side end flaps at either end of the carton may be secured together by means of known mechanical locks consisting of locking tabs and locking apertures. Such side end flaps with mechanical locks may be seen in U.S. Pat. No. 4,364,509 which is hereby incorporated by reference. It should be also appreciated that the side end flaps at either end of the carton may be disposed side by side without their overlapping each other. Such non-overlapping side end flaps, of course, are glued to the top and bottom end flaps. It should be further appreciated that the carton of the invention may be formed with beveled comer panels each interposed and foldably connecting between a top or bottom end flap and the adjacent one of the top and bottom walls. The beveled corner panels are also shown in U.S. Pat. No. 4,364,509.

What is claimed is:

1. A carton comprising top and bottom walls interconnected by a pair of opposed side walls to form a tubular structure, and an end closure structure provided at each end of said tubular structure to at least partially close said each end, one or each of said end closure structures comprising:

a bottom end flap foldably joined to said bottom wall and extending toward said top wall;

a pair of side end flaps foldably joined respectively to said side walls and extending to each other to traverse a respective end of said tubular structure and to cover at least part of said bottom end flap;

a pair of web panels each foldably interconnecting said bottom end flap and a respective one of said side end flaps and disposed in a face-contacting relationship with an inside surface of said respective side end flap;

a pair of first tear lines each formed in said respective side end flap and extending between an adjacent one of said side walls and an adjacent one of said web panels; and a pair of second tear lines each formed in said respective side end flap, said second tear lines emanating respectively from said first tear lines and extending to each other to form a single continuous line disposed above said first tear lines.

2. The carton according to claim 1 wherein said each web panel is joined to said respective side end flap along a fold line, and wherein said each first tear line extends from said adjacent side wall and terminates in coincidence with one of opposite ends of said fold line remote from said adjacent side wall.

3. The carton according to claim 1 wherein said each first tear line has an upper end disposed on a junction between said adjacent side wall and said respective side end flap.

4. The carton according to claim 3 wherein said second tear lines emanate respectively from said upper ends of said first tear lines.

5. The carton according to claim 3 wherein said each second tear line emanates from a point along an adjacent first tear line.

6. The carton according to claim 1 wherein said each first tear line is arched and lies concave to said second tear lines.

7. The carton according to claim 1 wherein said continuous line has an upwardly convexly curved portion for defining a centrally located pull tab.

8. The carton according to claim 1 wherein said continuous line has a downwardly convexly curved portion for defining a downwardly depending leg for engaging said bottom end flap.

9. The carton according to claim 1 further comprising a pair of third tear lines extending upwardly from said continuous line to define an access tab therebetween for facilitating tearing of said side end flaps along said second tear lines.

10. The carton according to claim 1 wherein said side end flaps are disposed in an overlapping relationship, and wherein said second tear lines extend coincidentally with each other in an area where said side end flaps are overlapped.

11. A carton blank comprising;

a bottom wall;

a pair of side walls foldably joined to opposite side edges of said bottom wall;

a bottom end flap foldably joined to an end edge of said bottom wall;

a pair of side end flaps foldably joined respectively to end edges of said side walls adjacent to said bottom end flap so that when said blank is erected into a carton, said side end flaps extend to each other to traverse a respective end of said carton and to cover at least part of said bottom end flap;

a pair of web panels each foldably interconnecting said bottom end flap and a respective one of said side end flaps;

a pair of first tear lines each formed in said respective side end flap and extending between an adjacent one of said side walls and an adjacent one of said web panels; and a pair of second tear lines each formed in said respective side end flap, said each second tear line extending from an adjacent one of said first tear lines to a free end edge of said respective side end flap so that when said carton is erected, said second tear lines form a single continuous line disposed above said first tear lines.

12. The carton blank according to claim 11 wherein said each web panel is joined to said respective side end flap along a fold line, and wherein said each first tear line extends from said adjacent side wall and terminates in coincidence with one of opposite ends of said fold line remote from said adjacent side wall.

13. The carton blank according to claim 11 wherein said each first tear line has an end disposed on a junction between said adjacent side wall and said respective side end flap.

14. The carton blank according to claim 13 wherein said second tear lines emanate respectively from said ends of said first tear lines.

15. The carton blank according to claim 13 wherein said each second tear line emanates from a point along an adjacent first tear line.

16. The carton blank according to claim 11 wherein said each first tear line is arched and lies concave to said second tear lines.

17. The carton blank according to claim 11 wherein said each second tear line has a curved portion lying convex to said bottom end flap, said curved portion defining a downwardly depending leg for engaging said bottom end flap when said carton is erected.

* * * * *